US005354379A

United States Patent [19]

Milbourn et al.

[11] Patent Number: 5,354,379

[45] Date of Patent: Oct. 11, 1994

[54] APPARATUS FOR APPLYING A PROTECTIVE COATING TO A FILM STRIP

[75] Inventors: Thomas M. Milbourn, Mahtomedi; Ashwani K. Mehta, Shoreview, both of Minn.

[73] Assignee: Minnesota Mining and Manufacturing Company, St. Paul, Minn.

[21] Appl. No.: 14,768

[22] Filed: Feb. 8, 1993

[51] Int. Cl.[5] ..... B05C 11/00

[52] U.S. Cl. ..... 118/696; 118/706; 118/72; 118/264; 118/267; 15/100; 134/122 P

[58] Field of Search ..... 118/696, 712, 620, 264, 118/267, 72, 706; 134/122 R, 122 P; 427/429; 15/100

[56] References Cited

U.S. PATENT DOCUMENTS

| | | | |
|---|---|---|---|
| 1,131,993 | 3/1915 | Chamberlin et al. | 118/267 |
| 1,523,527 | 1/1925 | Heidinger | 118/267 |
| 2,796,618 | 6/1957 | Arndt | 15/100 |
| 2,987,955 | 6/1961 | Sassenberg | 118/267 |
| 2,988,043 | 6/1961 | Sassenberg | 118/267 |
| 2,989,025 | 6/1961 | Chaffee | 118/267 |
| 3,198,287 | 8/1965 | Lyden | 118/267 |
| 3,218,187 | 11/1965 | Wade, Jr. | 118/267 |
| 3,727,576 | 4/1973 | Schriber | 118/264 |
| 4,056,024 | 11/1977 | Baert et al. | 83/210 |
| 4,100,134 | 7/1978 | Robins et al. | 528/10 |
| 4,156,046 | 5/1979 | Lien et al. | 428/220 |
| 4,293,606 | 10/1981 | Zollinger et al. | 428/203 |
| 4,447,468 | 5/1984 | Keable | 427/54.1 |
| 4,448,834 | 5/1984 | Pohl | 428/122 |
| 4,466,993 | 8/1984 | Hsu et al. | 118/267 |
| 4,497,861 | 2/1985 | Kistner | 428/201 |
| 4,612,875 | 9/1986 | Keable | 118/670 |
| 4,622,241 | 11/1986 | Keys | 118/267 |
| 4,674,438 | 6/1987 | Keable | 118/642 |
| 4,688,917 | 8/1987 | Müller et al. | 354/320 |
| 4,706,325 | 11/1987 | Michelson | 15/100 |
| 4,722,297 | 2/1988 | Keable | 118/670 |
| 4,845,019 | 7/1989 | Vaughan, IV | 430/422 |
| 4,945,934 | 8/1990 | Vaughan, IV | 134/64 R |
| 4,977,422 | 12/1990 | Vaughan, IV | 354/317 |
| 5,022,418 | 6/1991 | Vaughan, IV | 134/64 R |
| 5,136,968 | 8/1992 | Sarada et al. | 118/264 |
| 5,137,758 | 8/1992 | Kistner et al. | 427/350 |
| 5,144,474 | 9/1992 | Keable et al. | 354/319 |

FOREIGN PATENT DOCUMENTS

| | | |
|---|---|---|
| 0031301 | 7/1981 | European Pat. Off. . |
| 0362762 | 4/1990 | European Pat. Off. . |
| 1175025 | 12/1969 | United Kingdom . |

*Primary Examiner*—W. Gary Jones
*Assistant Examiner*—Steven P. Griffin
*Attorney, Agent, or Firm*—Gary L. Griswold; Walter N. Kirn; Thomas C. Lagaly

[57] ABSTRACT

A method and apparatus are provided for applying a protective coating to a film strip. The apparatus includes a coating unit for applying a coating of a curable liquid material to at least one surface of the film strip, a curing device for curing the coating of liquid material on the film strip into a protective coating, and a transport system for moving the film strip along a path extending from the coating unit to the curing device. The coating unit includes a substantially rigid, porous matrix having therein a plurality of interconnected pores, and is positioned such that the porous matrix contacts the surface of the film strip to be coated. The porous matrix stores the liquid material within the pores thereof and, upon contact with a surface of the film strip, transfers a coating of the liquid material thereto.

19 Claims, 3 Drawing Sheets

APPARATUS FOR APPLYING A PROTECTIVE COATING TO A FILM STRIP

BACKGROUND OF THE INVENTION

The present invention relates to the coating of film strips and, more particularly, to an apparatus and method for applying a protective coating, such as an ultraviolet curable protective coating, to one or both surfaces of a film strip, such as a photographic film strip.

Certain types of film, such as photographic film, are highly susceptible to damage from abrasive contact (e.g. scratching) and from contact with solvents or other liquid materials. As a result, protective coatings have been developed to protect such films from abrasive damage and from solvent contact. In addition, protective coatings may also reduce static electricity which attracts dust and dirt to the film, make fingerprints easy to wipe off, and otherwise protect and preserve the film. The most widely known and commonly used protective coatings are those which are curable by exposure to ultraviolet light, such as those described in U.S. Pat. No. 4,100,134 to Robins et al, U.S. Pat. No. 4,156,046 to Lien et al, U.S. Pat. No. 4,293,606 to Zollinger et al, and U.S. Pat. No. 4,497,861 to Kistner.

Conventional means for applying protective coatings to film strips involve high-speed devices which are both complex and expensive. An example of such a conventional coating device is described in U.S. Pat. No. 4,612,875 to Keable, which discloses a photographic film coater for applying an ultraviolet curable coating material to the opposite sides of roll film by a double-sided coater. Prior to coating, a group of film strips are usually spliced in end-to-end relation by paper splices and formed into a continuous reel. Film from the reel is drawn into a festoon section where it passes in serpentine fashion over a series of rollers until it reaches the double-sided coater. The double-sided coater includes a pair of coaters, each of which in turn includes a pickup roll and an applicator roll. Each pickup roll is partially immersed in a bath of liquid coating material and is positioned in close relation to the applicator roll such that, upon rotation of the pickup roll, the liquid material is transferred from the pickup roll to the applicator roll. Each of the pair of applicator rolls contact opposite sides of the film to transfer a coating of liquid material thereto. After the double-sided coater, the film is contacted by a series of smoothing bars to smooth the liquid coating, and then passes into an ultraviolet curing chamber to cure the liquid material. The film next moves to a film receiving chamber, then to a second festoon, and finally to a take-up reel.

While such complex, high-speed film coating devices are well suited for large commercial operations, they are prohibitively expensive and cumbersome for small operations in which single strips of film are coated on an infrequent basis depending upon individual customer demand. Due to the long and convoluted film path through the conventional coating devices, individual film strips must be spliced together to form a large, continuous reel before the film strips can be coated. As a result, an individual customer otherwise desiring immediate coating of a film strip must wait until a sufficient number of film strips are collected to form a suitably sized reel. In addition, conventional coating devices are somewhat sophisticated and require a fair amount of training in order to operate them.

Accordingly, a need exists in the art for a coating method and apparatus which are relatively inexpensive, easy to operate, and capable of quickly applying a protective coating to an individual film strip on short notice (e.g. while a customer waits). Such method and apparatus would facilitate small operations designed to provide protective coatings to individual photographic film strips immediately after being requested to do so by a consumer.

SUMMARY OF THE INVENTION

The present invention provides an inexpensive, easily operable, but highly effective coating apparatus and method for applying a protective coating to a film strip of discrete length. The coating apparatus of the present invention is particularly useful to serve the needs of individual customers who desire to have their photographic film strips (e.g. 35 millimeter film strips) quickly coated with a protective coating.

In accordance with one aspect of the present invention, an apparatus for applying a protective coating to a film strip is provided, and comprises a coating unit for applying a coating of a curable liquid material to at least one surface of the film strip, a curing device for curing the coating of liquid material on the film strip into a protective coating, and a transport system for moving the film strip along a path extending from the coating unit to the curing device. The coating unit includes a substantially rigid, porous matrix having therein a plurality of interconnected pores, and is positioned such that the porous matrix contacts the surface of the film strip to be coated. The porous matrix stores the liquid material within the pores thereof and, upon contact with a surface of the film strip, transfers a coating of the liquid material thereto.

As used herein, the term "substantially rigid, porous matrix" refers to a three dimensional substance Which contains an internal network of interconnected pores, and which is not dissolved by the particular liquid coating material used therewith. The substance should be capable of storing and transferring the liquid coating material within and from, respectively, the pores thereof, and should not be abrasive to the film strip. In addition, the porous matrix should be sufficiently rigid that it substantially maintains its shape when urged against the film strip to be coated while saturated with the liquid coating material. In this manner, the contact area between the porous matrix and the film strip will remain substantially constant in size and shape over time, thereby providing consistency and precision to the thickness and smoothness of the coating.

A preferred material for the porous matrix is porous polyvinyl alcohol. More preferably, the matrix is comprised of acetalized porous polyvinyl alcohol. Acetalized porous polyvinyl alcohol has been found to possess sufficient rigidity when saturated with liquid coating material that a consistently uniform protective coating is achieved. An alternative material from which the porous matrix may be selected is rigidified felt. The stiffness of the felt should be selected based on the particular liquid coating material used therewith to achieve satisfactory rigidity when saturated.

Preferably, the coating apparatus of the present invention includes means for supplying the liquid coating material to the porous matrix at a substantially constant rate, thereby providing a substantially uniform coating thickness over the surface of the film strip. It is also preferred that the apparatus include means for controlling the rate at which the liquid material is supplied to the porous matrix. In this manner, the thickness at which the protective coating is applied can be predetermined to a desired value.

Preferably, the liquid material comprises an ultraviolet curable material of the type described hereinabove, i.e., one which, when cured by exposure to ultraviolet light, protects the film strip from abrasive damage and from solvent contact, reduces static electricity which attracts dust and dirt to the film strip, makes fingerprints easy to wipe off, and otherwise protects and preserves the film strip. The curing device preferably includes an ultraviolet curing chamber having at least one ultraviolet lamp. The lamp is positioned to direct ultraviolet light at the film strip in the area where the liquid material has been applied, thereby effecting the curing of the liquid material on the film strip.

The coating apparatus of the present invention is particularly well suited to provide a protective coating to a photographic film strip bearing an image on one surface thereof. In this regard, the protective coating should be transparent and preferably has a final (i.e. dry) thickness ranging from about 2.0 to about 15.0 microns, and more preferably from about 2.0 microns to about 8.0 microns, with a thickness of around 2.5 microns being most preferred.

The transport system may include a constant speed motor having a drive shaft, and means for linking the rotation of the drive shaft to the translation of the film strip along the path extending from the coating unit to the curing device. Preferably, the linking means is releasably attached to the leading edge of the film strip such that the film strip is pulled along the path at a substantially constant speed when the motor is caused to operate.

The constant speed promotes uniformity in both the thickness and texture of the protective coating.

In accordance with another aspect of the present invention, there is provided a method for applying a protective coating to a film strip, comprising the steps of supplying a curable liquid material to a substantially rigid, porous matrix having therein a plurality of interconnected pores, contacting a surface of the film strip with the porous matrix such that the liquid material transfers from the porous matrix to the film strip as a coating, and curing the liquid-material on the film strip to form the protective coating. The porous matrix stores the liquid material within the pores thereof and transfers the liquid material to the film strip upon contact therewith.

As will be appreciated, the coating apparatus of the present invention is simple in design and in operation. Such simplicity results in an inexpensive device which is easily operable by minimally trained personnel. Notwithstanding the simplicity, however, the present coating apparatus and method result in a high quality coating having a uniform thickness and texture. Moreover, the coating apparatus and method of the present invention provide rapid coating to one or both sides of individual film strips with no preparation other than clamping the film strip to the transport system. As such, the present coating apparatus and method are uniquely suited for small enterprises desiring to provide protective film coating services to individual consumers.

DETAILED DESCRIPTION OF THE PREFERRED EMBODIMENTS

Figure 1:
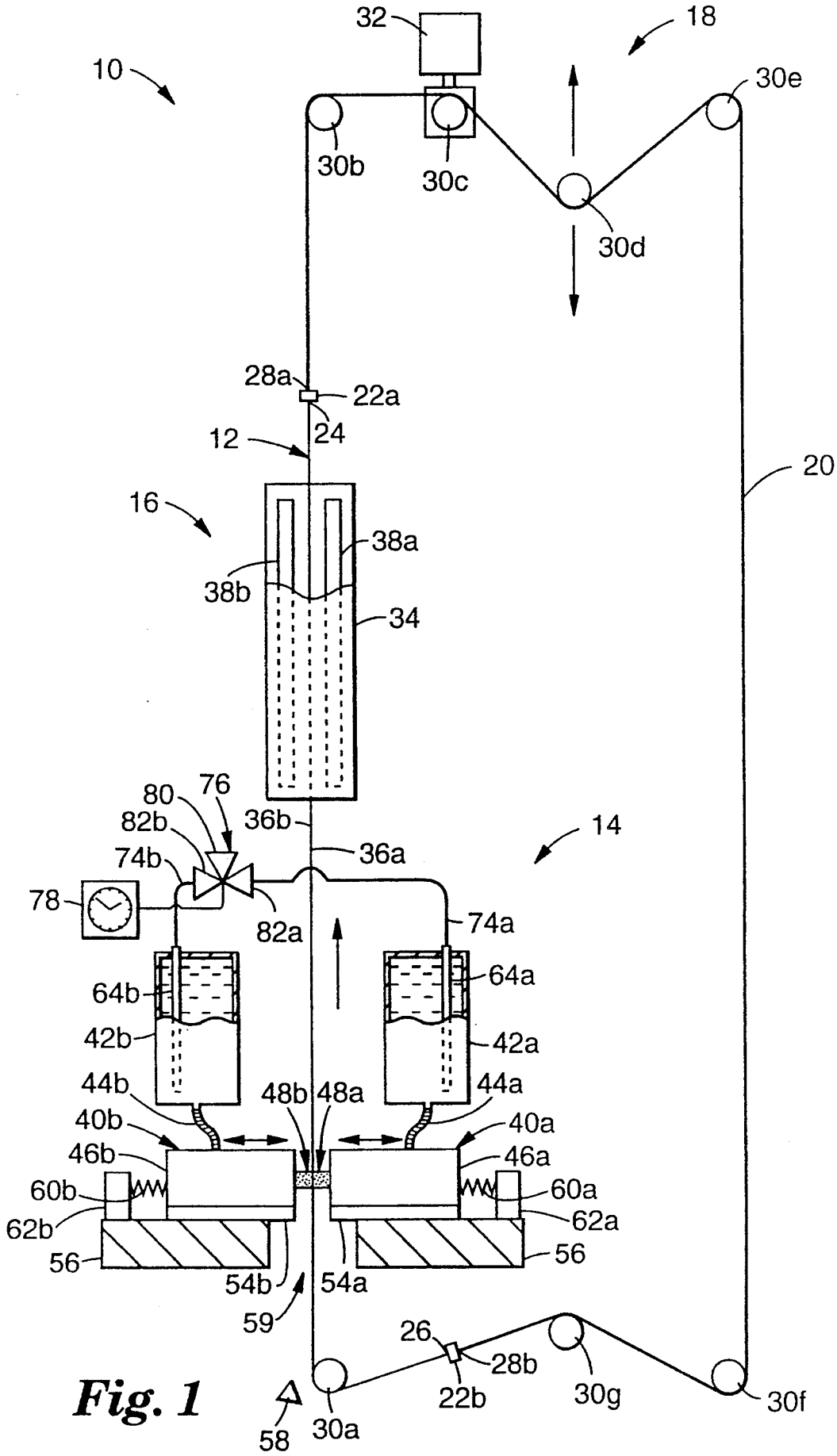
FIG. 1 is a schematic view of the coating apparatus of the present invention, shown applying a protective coating to a film strip.

Illustrated in FIG. 1 is the coating apparatus 10 of the present invention for applying a protective coating to a film strip 12. Coating apparatus 10 includes a coating unit 14, a curing device 16, and a transport system 18. As will be described in greater detail, coating unit 14 applies a coating of curable liquid material to at least one surface of film strip 12, curing device 16 cures the coating of liquid material on film strip 12 to form a protective coating thereon, and transport system 18 moves film strip 12 along a path extending from coating unit 14 to curing device 16. Coating unit 14, curing device 16, and transport system 18 are preferably positioned such that film strip 12 moves along a vertical, upward moving path through coating unit 14 and curing device 16, as shown. However, film strip 12 may also be made to travel along a path having any other orientation (e.g., horizontally).

Film strip 12 may be any type of film or sheet material to which it is desired to add a protective coating to one or both surfaces thereof. For example, film strip 12 may be a single strip of processed and developed 35 millimeter photographic film bearing an image on one surface thereof.

Preferably, transport system 18 moves film strip 12 at a substantially constant speed through coating apparatus 10. This, in combination with other factors which will be described below, ensures that the thickness of the protective coating applied to film strip 12 is substantially constant over the length of film strip 12. Generally, transport system 18 includes a constant speed motor having a drive shaft, and means for linking the rotation of the drive shaft to the translation of film strip 12 along a path extending from coating unit 14 to curing device 16. The preferred means for linking the rotation of the drive shaft to the translation of film strip 12 is illustrated in FIG. 1. Film strip 12 is attached to leader 20 by way of clamps **22*a* and 22*b*. Clamp 22*a* is releasably attached to the leading edge 24 of film strip 12, while clamp 22*b* is releasably attached to the trailing edge 26 of film strip 12. Clamps 22*a,b* are permanently attached to the ends 28*a,b* of leader 20, and may be any type of commercially available metal or polymeric clamp capable of applying sufficient compressive force to the edges 24 and 26 of film strip 12 that film strip 12 remains attached to leader 20 throughout the coating process. Leader 20** may be constructed of a strip or band of any material which is thin, pliable, stretch resistant, and ultraviolet light resistant. Examples of suitable materials include metal, nylon, and polypropylene.

When clamps **22*a,b* are attached to edges 24 and 26 of film strip 12, a loop is formed. The "loop" passes over a series of rollers 30*a–g*. Rollers 30*a,b* are positioned to provide a vertical path through coating unit 14 and curing device 16. Roller 30*c* is attached axially to the drive shaft (not shown) of constant speed motor 32, such that roller 30*c* rotates about its longitudinal axis when motor 32 is caused to operate. Roller 30***c* is in frictional contact with the "loop" (i.e. with either film strip 12 or leader 20) such that its rotation causes film strip 12 and leader 20 to travel along the path formed by rollers 30*a–g* in the direction shown. Thus, the operation of motor 32 causes the circulation of the "loop" and, more specifically, the translation of film strip 12 along the path extending from coating unit 14 to curing device 16. Motor 32 can be any type of motor which is capable of producing constant rotational speed, such as a gearhead motor.

Roller 30*d* can be vertically adjusted to accommodate film strips of different lengths. For a film strip having a length which is shorter than the one shown, roller 30*d* is moved vertically upwards from the position shown. This serves to shorten the path length of the "loop" and allows the shorter film strip to be attached to leader 20. Similarly, roller 30*d* would be moved vertically downwards to lengthen the "loop" to accommodate a longer film strip. Rollers 30*e–g* are additional guide rollers.

Preferably, coating apparatus 10 includes means for cleaning surfaces 36*a,b* of film strip 12 prior to the application of the protective coating thereto. Such cleaning means can be provided by including on the surfaces of rollers 30*g* and 30*a* a tacky substance which is capable of removing dust and dirt from the surfaces 36*a,b* of film strip 12. Suitable rollers, known as "Particle Transfer Rollers" having an inert polyurethane material on the surface thereof, are available from Eastman Kodak.

As an alternative to the leader and roller arrangement shown in FIG. 1, transport system 18 may include a sprocket centrally attached to the drive shaft of constant speed motor 32, and a chain releasably attached to the leading edge 28*a* of film strip 12. The chain is engaged with the sprocket such that, when motor 32 is caused to operate, film strip 12 is pulled through coating unit 14 and then through curing device 16. After the full length of film strip 12 has passed through coating unit 14 and through curing device 16, film strip 12 is released from the chain. Motor 32 is then reversed to lower the chain into position to pull another film strip through coating apparatus 10.

The curable liquid material which is applied to film strip 12 can be any type which is capable of curing into a protective coating. Particularly preferred are those liquid materials which are ultraviolet curable into abrasion-resistant, liquid resistant, and static-resistant protective coatings, such as those which are described in U.S. Pat. Nos. 4,100,134, 4,156,046, 4,293,606, and 4,497,861.

When an ultraviolet-curable liquid material is chosen to be applied to film strip 12, curing device 16 preferably includes an ultraviolet curing chamber 34 having therein at least one ultraviolet lamp. When, as shown in FIG. 1, both surfaces 36*a* and 36*b* of film strip 12 are coated with an ultraviolet curable liquid material, two ultraviolet lamps, 38*a* and 38*b*, are included within curing chamber 34. Ultraviolet lamps 38*a,b* are positioned within curing chamber 34 to direct ultraviolet light at film strip 12 in the area where the liquid material has been applied, i.e., at each of the coated surfaces 36*a,b*. As shown, this is accomplished by aligning the longitudinal axes of lamps 38*a,b* with that of film strip 12. Further, lamp 38*a* is positioned immediately adjacent surface 36*a*, and lamp 38*b* is positioned immediately adjacent surface 36*b*. When the ultraviolet light from lamps 38*a,b* impinges upon coated surfaces 36*a,b*, the coating on each of those surfaces cures into a protective coating.

The wattage and ultraviolet wavelength which must be generated by ultraviolet lamps 38*a,b* are dependent upon such factors as the speed at which film strip 12 is transported through curing chamber 34, the particular type of liquid coating material applied to film strip 12, and the thickness at which the coating is applied. For example, at a film speed of 5 feet per minute through curing chamber 34, and upon the application of sufficient ultraviolet curable liquid material to result in a final coating thickness of between 2 and 15 microns, ultraviolet lamps 38*a,b* may appropriately have a wattage ranging from 5 to 50, and produce ultraviolet light having a wavelength ranging from 200 to 420 nanometers. Within these ranges, the preferred wattage is 25 and the preferred wavelength range is from 230 to 380 nanometers. Advantageously, such low wattage ultraviolet lamps are inexpensive, but provide effective curing at film speeds of around 5 feet per minute, and at final coating thicknesses of between 2 and 15 microns, such that the protective coating is substantially completely cured and dry by the time film strip 12 reaches roller 30*b*.

Depending upon the composition of the curable liquid material, curing device 16 may alternatively provide a source of incandescent or fluorescent energy, electron beam radiation, ultrasonic energy, infrared radiation, microwave energy, or x-ray excitation.

Figure 2:
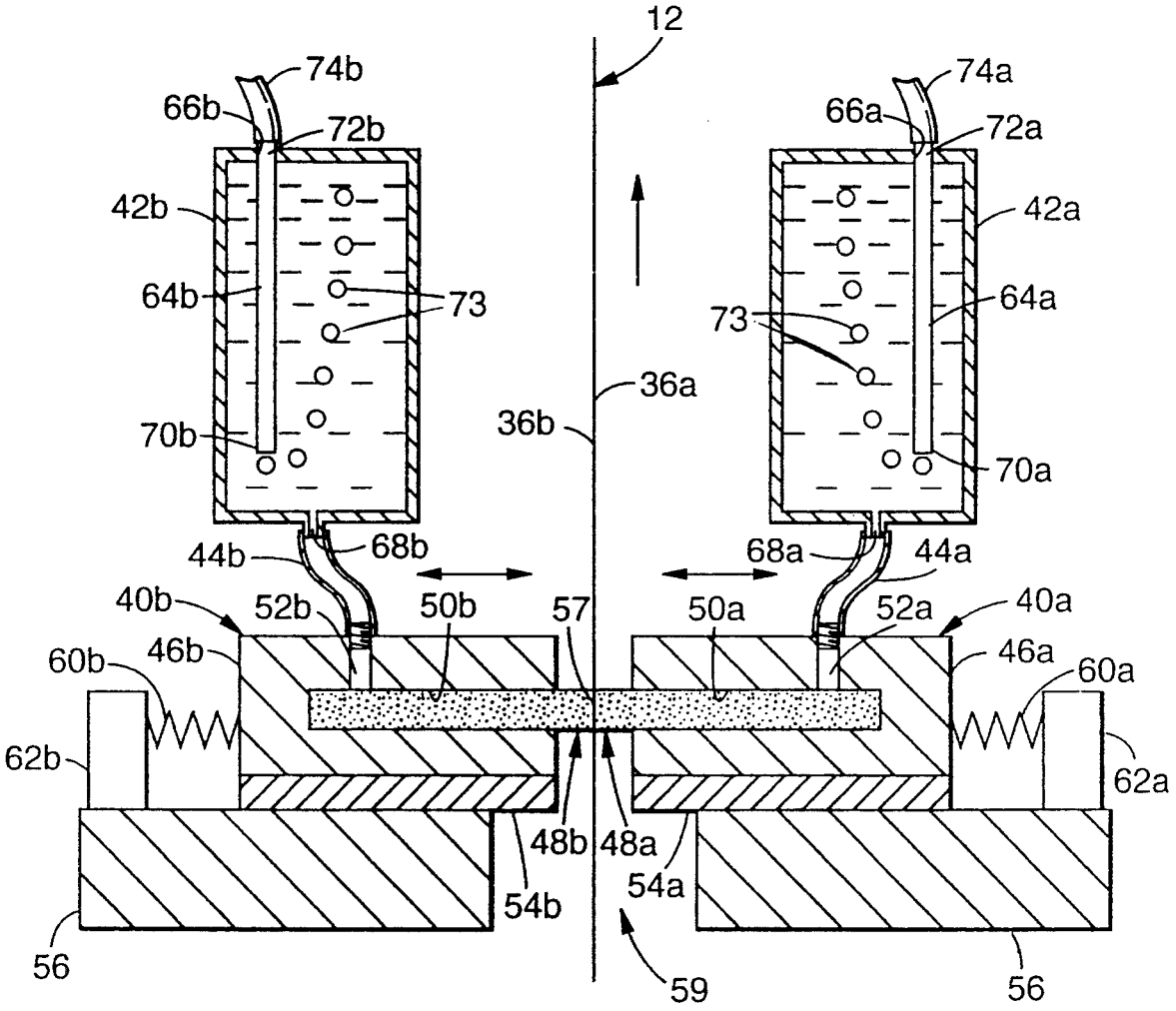
FIG. 2 is an enlarged, cross-sectional view of the coating unit shown in FIG. 1.

With reference now to FIGS. 1 and 2 collectively, the structure and operation of coating unit 14 will be described in greater detail. Coating unit 14 includes a pair of coating heads 40*a* and 40*b* fluidly communicating with reservoirs 42*a* and 42*b*, respectively, via supply tubes 44*a* and 44*b*. Reservoirs 42*a,b* contain the liquid coating material to be applied to surfaces 36*a,b* of film strip 12. Each of coating heads 40*a,b* include a housing member 46*a* and 46*b*, respectively, and a coating applicator 48*a* and 48*b*, respectively. Each of the coating applicators 48*a,b* are partially enclosed within a corresponding one the housing members 46*a,b*, with the remaining portion extending beyond the housing member to contact one of the surfaces of film strip 12. As shown, coating applicator 48*a* is in contact with surface 36*a* of film strip 12 while coating applicator 48*b* is in contact with surface 36*b* of film strip 12.

The enclosed portions of coating applicators 48*a,b* are contained within respective internal cavities 50*a,b* of housing members 46*a,b*. Internal cavities 50*a,b* receive liquid coating material from respective supply tubes 44*a,b* via fluid inlets 52*a,b*. The liquid coating material received by internal cavities 50*a,b* is absorbed by coating applicators 48*a,b*. As will be described more fully below, each of coating applicators 48*a,b* comprise a substantially rigid, porous matrix having therein a plurality of interconnected pores. The liquid coating material is stored within the pores thereof and transferred, in the form of a coating, to one of surfaces 36*a,b* of film strip 12 upon contact therewith.

Coating heads 40*a,b* are mounted on respective slides 54*a,b*. Slides 54*a,b* are translationally slidable on base member 56 both towards and away from film strip 12, as indicated by the directional arrows shown in FIGS. 1 and 2. In this manner, coating applicators 48*a,b* of coating heads 40*a,b* can be translated into and out of contact with film strip 12 as desired. Slides 54*a,b* can be any one of a number of commercially available slide mechanisms, such as a Gilman slide or a cross-roller slide, and can be powered by any convenient drive mechanism, such as one driven electrically, hydraulically, or pneumatically.

Preferably, coating heads 40*a,b* assume the position shown in FIGS. I and 2 (hereinafter referred to as the "contact position") only when portions of film strip 12 are in the convergence zone 57 between coating applicators 48*a* and 48*b*. Thus, when motor 32 is operating such that the "loop" formed by film strip 12 and leader 20 is traveling around the path defined by rollers 30*a–g*, slides 54*a,b* will translate coating heads 40*a,b* away from one another (hereinafter referred to as the "noncontact position") when either clamps 22*a,b* or portions of leader 20 would otherwise be sandwiched between coating applicators 48*a,b* in convergence zone 57. In this manner, liquid coating material will not be wasted on leader 20 and coating applicators 48*a,b* will not be damaged by contact with clamps 22*a,b*.

A preferred means for controlling the movement of coating heads 40*a,b* is to position a sensor near coating heads 40*a,b* to detect which portion of the "loop" is about to enter coating unit 14 through aperture 59 in base member 56. As shown in FIG. 1, sensor 58 is positioned near roller 30*a* and detects which portion of the "loop" is traveling around roller 30*a*. Depending upon the portion of the "loop" detected, a specific signal is sent to slides 54*a,b* causing appropriate positioning of coating heads 40*a,b*.

For example, film strip 12 may be initially clamped to leader 20 at the segment of the "loop" located in between rollers 30*e* and 30*f*. In this instance, coating heads 40*a,b* will be initially in the noncontact position since leader 20 will be in the convergence zone 57 and would otherwise be sandwiched by coating applicators 48*a,b* (thus wasting liquid coating material by applying it to leader 20). Motor 32 will then be started, Causing the "loop" to rotate in a clockwise direction. When sensor 58 detects clamp 22*a* (attached to leading edge 24 of film strip 12) traveling around roller 30*a*, a time-delayed signal will be sent to slides 54*a,b*, causing the convergence of coating heads 40*a,b* into the contact position just after clamp 22*a* has passed above convergence zone 57. The time delay, dependent upon the speed at which the "loop" travels, allows clamp 22*a* to pass through aperture 59 and convergence zone 57 before coating applicators 48*a,b* are moved into the contact position.

In the contact position thus assumed, coating applicators 48*a,b* will be in position to contact respective surfaces 36*a,b* of film strip 12. Preferably, coating unit 14 includes biasing means for urging coating applicators 48*a,b* against film strip 12 when coating heads 40*a,b* are in the contact position. Such biasing means may include linear springs 60*a,b*, which are attached to base member 56 via anchor blocks 62*a,b*. When coating heads 40*a,b* are in the contact position as shown in FIGS. 1 and 2, linear springs 60*a,b* urge coating applicators 48*a,b* against respective surfaces 36*a,b* of film strip 12, thereby sandwiching film strip between coating applicators 48*a,b* and causing stored liquid coating material to transfer from coating applicators 48*a,b* onto respective surfaces 36*a,b* in the form of a coating. Film strip 12 continues past coating heads 40*a,b* in this manner until both surfaces 36*a,b* are coated with the liquid coating material.

When sensor 58 detects clamp 22*b* (attached to trailing edge 26 of film strip 12) traveling around roller 30*a*, a time-delayed signal will be sent to slides 54*a,b*, causing the divergence of coating heads 40*a,b* to the noncontact position just after clamp 22*b* has passed above coating applicators 48*a,b*. Thus, coating applicators 48*a,b* will contact only film strip 12, and will neither be damaged by contacting clamps 22*a,b* nor waste liquid coating material by contacting leader 20. Sensor 58 can be any type of proximity sensor or other suitable sensing device such as an infrared sensor or, if clamps 22*a,b* are constructed of metal, a magnetic sensor. Additional sensors can be included as desired. For example, a second sensor can be positioned above curing device 16. When this sensor detects clamp 22*b* moving away from curing device 16 (indicating that the coating and curing of film strip 12 is complete), an appropriate signal is sent to motor 32 causing the motor to cease operating so that film strip 12 can be unclamped from leader 20.

Preferably, coating unit 114 includes means for supplying the liquid coating material to coating heads 40*a,b* at a substantially constant rate, thereby facilitating a substantially uniform protective coating thickness along the length of surfaces 36*a,b* of film strip 12. A particularly cost effective means for supplying the liquid material at a constant-rate includes the provision of displacement tubes 64*a,b* into respective reservoirs 42*a,b*. Reservoirs 42*a,b* are completely sealed except for respective openings 66*a,b* and fluid outlets 68*a,b*. Displacement tubes 64*a,b* extend substantially vertically into respective reservoirs 42*a,b* via openings 66*a,b*, and include first ends 70*a,b* and second ends 72*a,b*. First ends 70*a,b* terminate near the bottom portion of reservoirs 42*a,b*. Second ends 72*a,b* communicate with a gas source via gas lines 74*a,b*. A convenient gas source is the atmosphere, but depending upon the particular liquid coating material used, a different gas source may be required.

Gas from the gas source exits displacement tubes 64*a,b* at first ends 70*a,b*, as represented by gas bubbles 73 in FIG. 2, thereby displacing the liquid coating material as the material is supplied to coating heads 40*a,b*. The liquid coating material is supplied to coating heads 40*a,b* via fluid outlets 68*a,b*, which communicate with supply tubes 44*a,b*. Reservoirs 42*a,b* are preferably positioned above coating heads 40*a,b* so that the liquid material flows thereto by force of gravity. Because reservoirs 42*a,b* are sealed, the liquid material is prevented from flowing out of fluid outlets 68*a,b* until displacement gas is allowed to enter the reservoirs through displacement tubes 64*a,b*.

It has been found that the flow rate of liquid material from reservoirs 42*a,b* remains constant regardless of the liquid level therein when displacement gas is introduced in the manner as described. That is, as long as the level of the liquid coating material in reservoirs 42*a,b* is above that of first ends 70*a,b* of displacement tubes 64*a,b*, decreasing head pressure at fluid outlets 68*a,b* (caused by decreasing level of the liquid coating material in reservoirs 42*a,b* as it is expended over the course of coating a film strip) will not result in an appreciable decrease in flow rate of the liquid material as it is supplied to coating heads 40*a,b*. As a result, even though the level of liquid coating material in reservoirs 42*a,b* will decrease during the course of coating a film strip, the rate at which the liquid material is applied to the film strip will remain substantially constant during the coating process, thereby ensuring a substantially uniform coating thickness over the length of the film strip.

Preferably, coating unit 14 further includes means for controlling the rate at which the liquid coating material is supplied to coating heads 40*a,b*. As illustrated in FIG. 1, such means may include valve 76 and control device 78. Valve 76 and control device 78 control the rate at which the liquid material is supplied to coating heads 40a,b by controlling the rate and amount of displacement gas which is introduced into reservoirs 42a,b via displacement tubes 64a,b. Reservoirs 42a,b are sealed substantially air-tight such that gas can enter only through displacement tubes 64a,b. Thus, the rate at which liquid coating material exits reservoirs 42a,b through fluid outlets 68a,b is proportional to the rate at which displacement gas enters reservoirs 42a,b through displacement tubes 64a,b.

Valve 76 is operable between an open position and a closed position, and communicates with gas lines 74a,b (which in turn communicate with second ends 72a,b of displacement tubes 64a,b) and with a gas source (e.g. the atmosphere, as shown). Displacement gas is permitted to enter reservoirs 42a,b only when valve 76 is in the open position. In contrast, displacement gas is prevented from entering reservoirs 42a,b when valve 76 is in the closed position. As illustrated, valve 76 is a three-way valve. When in the open position, air enters valve 76 through inlet port 80, exits valve 76 through outlet ports 82a,b, flows through gas lines 74a,b, and enters reservoirs 42a,b via displacement tubes 64a,b.

In an alternative embodiment, only one reservoir, displacement tube, and gas line are provided. In this embodiment, supply tubes 44a,b are both attached to the single reservoir (e.g. through the use of a tee), and valve 76 is a two-way valve with one inlet port communicating with a gas source and one outlet port communicating with the single gas line (which in turn communicates with the single displacement tube in the reservoir).

In either event, control device 78 controls the operation of valve 76 between the open position and the closed position to control the rate at which displacement gas enters reservoirs 42a,b, thereby controlling the rate at which the liquid coating material is supplied to coating heads 40a,b. Control device 78 and valve 76 can control the rate at which gas enters reservoirs 42a,b in two ways: by controlling the frequency at which valve 76 opens and closes, and by controlling the duration of time during which valve 76 is left in the open or closed position. The rate of gas entry into reservoirs 42a,b is directly proportional both to the frequency at which valve 76 is switched from the closed to the open position, and to the amount of time during which valve 76 is left in the open position. Both of these variables can be controlled by control device 78 as necessary to achieve a desired coating thickness, since the coating thickness is directly proportional to the rate at which the liquid coating material is supplied to coating heads 40a,b which, in turn, is proportional to the rate of gas entry into reservoirs 42a,b.

Valve 76 is preferably an electrically controlled valve and control device 78 is preferably a pulser/timer which sends electric pulses to valve 76 to control its operation. Control device 78 can thus be preset to send electric pulses to valve 76 at predetermined intervale and for a predetermined duration to control both the frequency at which valve 76 opens and closes and the duration of time during which valve 76 is left in the open or closed position. By appropriate selection of the pulse interval and/or pulse duration, the thickness of the protective coating applied to film strip 12 can be precisely controlled to any desired value.

Valve 76 can be any type of valve which is suitable for vacuum service, such as a high-speed, direct solenoid poppet valve available from Dynamco. Control device 78 can be any type of commercially available device capable of accepting manual or remote inputs to produce electric pulses of preselected frequency and duration. Conveniently, control device 78 may be tied into the time delayed signal from sensor 58 such that control device 78 begins to cause liquid coating material to flow to coating heads 40a,b at the same time as coating heads 40a,b move into the contact position to apply the coating material to film strip 12.

In the case of 35 millimeter photographic film, the final thickness of the protective coating may range from about 2.0 microns to about 15.0 microns, and preferably ranges from about 2.0 0microns to about 8.0 microns, with a thickness of about 2.5 microns being most preferred. For example, to achieve a coating thickness of 2.5 microns on both surfaces of a 35 millimeter film strip, the flow rate of liquid coating material which must be supplied to coating heads 40a,b from reservoirs 42a,b is about 0.267 milliliters per minute when transport system 18 moves the film through coating unit 14 at a speed of 5 feet per minute. In this example, control device 78 must be preset to allow a sufficient rate of gas entry into reservoirs 42a,b to displace 0.267 millimeters per minute of liquid coating material. This determination can be made through proper calibration techniques.

Figure 3:
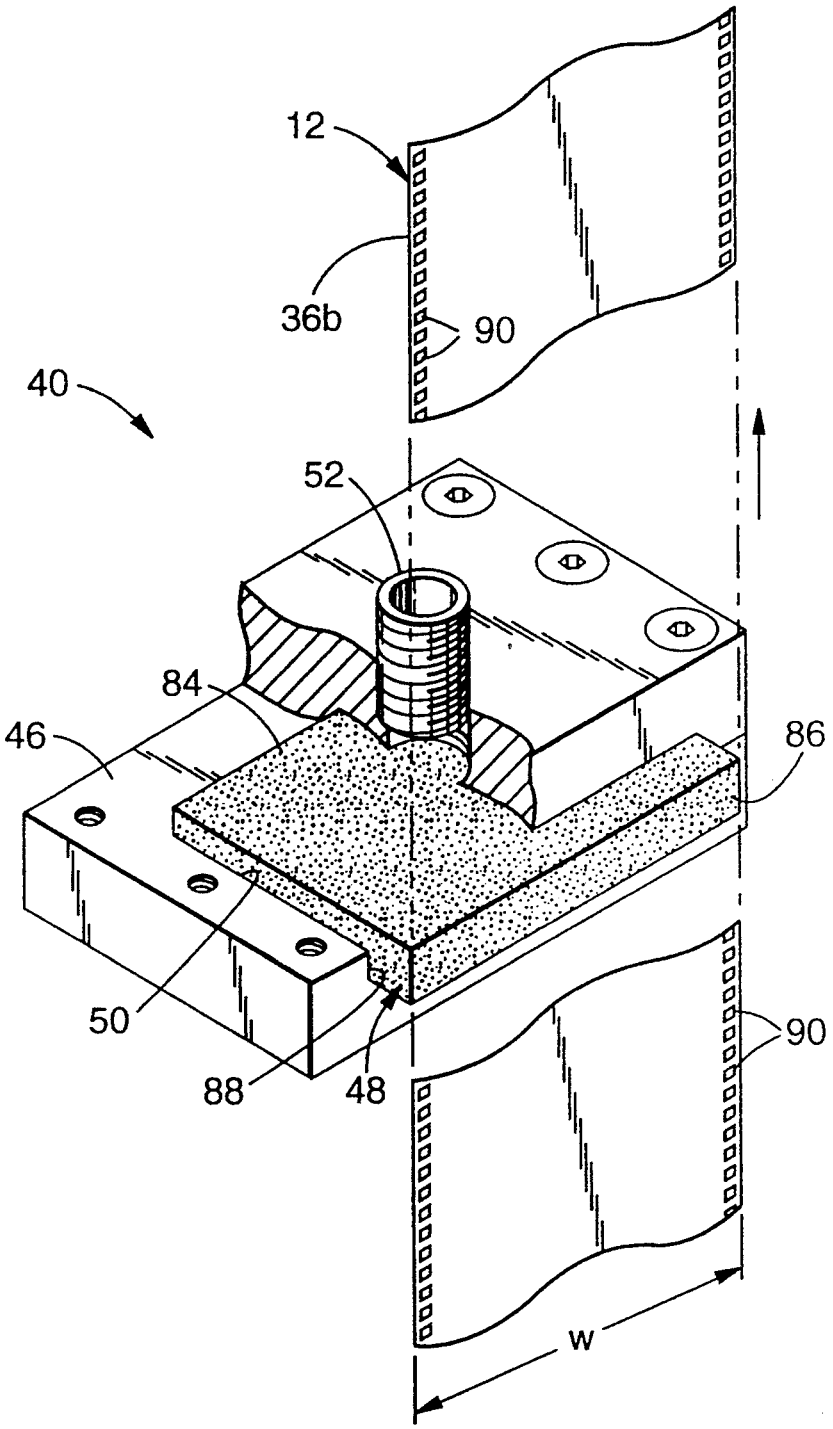
FIG. 3 is a fragmentary perspective view of one of the pair of coating heads shown in FIGS. 1 and 2.

Referring now to FIG. 3, coating heads 40a,b will described in greater detail. Coating heads 40a and 40b are identical, and the coating head shown in FIG. 3 is illustrative of both coating heads. Thus, for purposes of describing the coating head shown in FIG. 3, the notations "a" and "b" will be dropped from the reference numerals used to describe the coating heads and their components. As thus illustrated, coating head 40 includes coating applicator 48 partially enclosed within internal cavity 50 of housing member 46. Liquid coating material from one of reservoirs 42a,b flows into internal cavity 50 via fluid inlet 52 and is absorbed by coating applicator 48. The liquid coating material is stored within the pores of coating applicator 48 and transferred, in the form of a coating, to one of surfaces 36a or 36b of film strip 12 upon contact therewith. For purposes of illustration, it will be assumed that the liquid coating material is being applied to surface 36b in FIG. 3. As shown, coating applicator 48 is preferably sized to apply the liquid coating material to substantially the entire width "w" of surface 36b of film strip 12. In this regard, coating applicator 48 is preferably at least as wide as the width of the film strip to be coated, and preferably slightly wider to allow for any lateral movement of the film strip as it moves through coating unit 14.

Coating applicator 48 includes an enclosed portion 84 and a contact portion 86. Enclosed portion 84 is enclosed within the internal cavity 50 of housing member 46 and receives the liquid coating material from fluid inlet 52. In operation, the liquid material flows from enclosed portion 84 to contact portion 86. Contact portion 86 extends outside of internal cavity 50 via opening 88. Opening 88 faces surface 36b of film strip 12 such that contact portion 86 of coating applicator 48 can be brought into contact with surface 36b by simple linear motion (i.e. by force of linear spring 60a or 60b) in order to transfer a coating of the liquid material thereto.

Coating applicator 48 comprises a substantially rigid, porous matrix having therein a plurality of interconnected pores. As used herein, the term "substantially rigid, porous matrix" refers to a three dimensional substance which contains an internal network of interconnected pores, and which is not dissolved by the particular liquid coating material used therewith. The substance should be capable of storing and transferring the liquid coating material within and from, respectively, the pores thereof, and should not be abrasive to the film strip. In addition, the porous matrix should be sufficiently rigid that it substantially maintains its shape when urged against the film strip to be coated while saturated with the liquid coating material. In this manner, the contact area between the porous matrix and the film strip will remain substantially constant in size and shape over time, thereby providing consistency and precision to the thickness and smoothness of the coating.

In the coating of photographic film strips in particular, it is important that the protective coating be uniform in thickness and consistency over the entirety of the coated surface. The rigidity of the porous matrix of which coating applicator 48 is comprised helps to ensure this by providing a substantially non-deformable coating application surface. The porous matrix should also be sufficiently rigid to withstand the abrasive force caused by the grinding action of perforations 90 in film strip 12 as they move through coating heads 40*a,b* while being compressively sandwiched between coating applicators 48*a,b*.

The preferred porous matrix material from which coating applicator 48 is constructed is porous polyvinyl alcohol. More preferably, the material is acetalized porous polyvinyl alcohol. Acetalized porous polyvinyl alcohol is manufactured by Kanebo and is available from Shima American Corporation, Elmhurst, Illinois. It is preferred that the pores of coating applicator 48 be as small as possible to effect uniform distribution of the liquid coating material on the surface of film strip 12, but not so small as to impede the flow of the liquid therethrough such that gravity flow is no longer possible. Acetalized porous. polyvinyl alcohol from Kanebo ranges in pore size from about 8 microns to about 1000 microns, and ranges in density from about 0.10 grams per cubic centimeter to about 0.15 grams per cubic centimeter. In applying a protective coating to a 35 millimeter film strip, Grade D acetalized porous polyvinyl alcohol from Kanebo, having an average pore size of 60 microns and a density of 0.15 grams per cubic centimeter, has been found to exhibit sufficient rigidity and fluid flow distribution characteristics to meet the criteria herein described.

An alternative porous matrix material from which coating applicator 48 can be constructed is felt having sufficient rigidity and fluid flow distribution characteristics to meet the criteria herein described. Suitable materials from which the felt may be constructed include fibers of polyester, nylon, polyurethane, ceramic material, carbon, cotton, or animal fibers such as wool. The porous matrix material could also constructed from cork or a hardened foam material.

While representative embodiments and certain details have been shown for purposes of illustrating the invention, it will be apparent to those skilled in the art that various changes in the methods and apparatus disclosed herein may be made without departing from the scope of the invention, which is defined in the appended claims.

What is claimed is:

1. An apparatus for applying a coating of a liquid material to opposite surfaces of a film strip, comprising:

a base member having an aperture therethrough;

means for moving said film strip through said aperture;

a pair of housing members attached to said base member and positioned such that each of said pair of housing members is adjacent one of said opposite surfaces of said film strip, each of said pair of housing members having an internal cavity with a first and second opening thereto, said first opening of each housing member facing an opposing one of said opposite surfaces of said film strip;

a pair of coating applicators, each comprising a substantially rigid, porous matrix having therein a plurality of interconnected pores, each of said pair of coating applicators being housed within one of said pair of housing members and having an enclosed portion and a contact portion, said enclosed portion being enclosed within the internal cavity of a corresponding one of said pair of housing members and said contact portion extending outside of said internal cavity via said at least one opening, said coating applicators storing said liquid material within the internal pores thereof and transferring a coating of said liquid material to each of the opposite surfaces of said film strip upon contact therewith;

means for supplying said liquid material to each of said pair of coating applicators at a substantially constant rate, said supplying means comprising:

at least one reservoir having top, bottom, and side portions to define an internal volume containing a quantity of said liquid material, said at least one reservoir having an opening in said top portion and a fluid outlet in said bottom portion communicating with each of said second opening into the internal cavity of each of said pair of housing members, and a tube extending substantially vertically into said reservoir via said opening, said tube having a first end terminating near said bottom portion of said reservoir and a second end communicating with a gas source, gas from said source displacing said liquid material as said liquid material is supplied to said coating applicators such that the flow rate of liquid material from said reservoir is substantially constant when the level of said liquid material in said reservoir is above that of said first end of said tube;

means for controlling the rate at which said liquid material is supplied to said coating applicators, said means for controlling the rate comprising:

a valve communicating with said second end of said tube, said valve being operable between an open position and a closed position such that gas enters said second end of said tube when said valve is in said open position and is prevented from entering said second end of said tube when said valve is in said closed position, and a control device for controlling operation of said valve between said open position and said closed position to control the rate at which gas enters said second end of said tube, thereby controlling the rate at which said liquid material is supplied to said coating applicators; and means for engaging said contact portion of each of said pair of coating applicators with a different one of said opposite surfaces of said film strip to thereby apply a coating of said liquid material to each of said opposite surfaces of said film strip.

2. The apparatus of claim 1 wherein at least one of said pair of housing members is movable on said base member in the direction of the other of said pair of housing members such that said contact portions of each of said pair of coating applicators are capable of contacting one another in the absence of a film strip in said apparatus, and wherein said engaging means includes biasing means, attached to said at least one movable housing member, for urging said contact portions against one another as said film strip is moved through said aperture, thereby sandwiching said film strip between said contact portions of said pair of coating applicators to simultaneously apply said coating of said liquid material to each of said opposite surfaces of said film-strip.

3. The apparatus of claim 1 wherein said film strip comprises a photographic film strip, and wherein said liquid material comprises an ultraviolet curable material capable of curing into a substantially transparent protective coating on said opposite surfaces of said film strip.

4. The apparatus of claim 3 wherein said coating has a thickness ranging from about 2.5 microns to about 7.5 microns.

5. The apparatus of claim 1 wherein said pair of coating applicators comprise porous polyvinyl alcohol.

6. The apparatus of claim 1 wherein said pair of coating applicators comprise felt.

7. The apparatus of claim 1 wherein said at least one reservoir is positioned above said housing members such that said liquid material is supplied to said coating applicators by force of gravity, and wherein said gas from said gas source comprises air from the atmosphere.

8. An apparatus for applying a protective coating to a film strip, comprising:

a coating unit for applying a coating of curable liquid material to at least one surface of said film strip, said coating unit including a substantially rigid, porous matrix having therein a plurality of interconnected pores and being positioned to contact said at least one surface of said film strip, said porous matrix storing said liquid material within the pores thereof and transferring a coating of said liquid material to said at least one surface of said film strip upon contact therewith;

means for supplying said liquid material to said porous matrix at a substantially constant rate, said supplying means comprising:

a reservoir having top, bottom, and side portions to define an internal volume containing a quantity of said liquid material, said reservoir having an opening in said top portion and a fluid outlet in said bottom portion, a housing containing an internal cavity, said internal cavity having a first opening and a second opening and enclosing a portion of said porous matrix which is less than all of said porous matrix, the remaining portion of said porous matrix extending beyond said housing through said first opening to contact said at least one surface of said film strip, said second opening fluidly communicating with said fluid outlet of said reservoir, and a tube extending substantially vertically into said reservoir via said opening, said tube having a first end terminating near said bottom portion of said reservoir and a second end communicating with a gas source, gas from said gas source displacing said liquid material as said liquid material is supplied to said porous matrix such that the flow rate of liquid material from said reservoir is substantially constant when the level of said liquid material in said reservoir is above that of said first end of said tube;

means for controlling the rate at which said liquid material is supplied to said porous matrix, said means for controlling the rate comprising:

a valve communicating with said second end of said tube, said valve being operable between an open position and a closed position such that gas enters said second end of said tube when said valve is in said open position, and is prevented from entering said second end of said tube when said valve is in said closed position, and a control device for controlling operation of said valve between said open position and said closed position to control the rate at which gas enters said second end of said tube, thereby controlling the rate at which said liquid material is supplied to said porous matrix;

a curing device for curing said coating of liquid material on said film strip to form said protective coating; and a transport system for moving said film strip along a path extending from said coating unit to said curing device.

9. The apparatus of claim 8 wherein said coating unit further includes biasing means for urging said porous matrix against said film strip.

10. The apparatus of claim 8 wherein said porous matrix comprises porous polyvinyl alcohol.

11. The apparatus of claim 8 wherein said porous matrix comprises felt.

12. The apparatus of claim 8 wherein said porous matrix is sized to apply said liquid material to substantially the entire width of said at least one surface of said film strip.

13. The apparatus of claim 8 wherein said reservoir is positioned above said housing such that said liquid material is supplied to said porous matrix by force of gravity, and wherein said gas from said gas source comprises air from the atmosphere.

14. The apparatus of claim 8 wherein said transport system moves said film strip along said path at a substantially constant speed.

15. The apparatus of claim 14 wherein said transport system includes:

a constant speed motor having a drive shaft, said motor causing said drive shaft to rotate at a substantially constant speed; and means for linking the rotation of said drive shaft to the translation of said film strip along said path, said linking means being releasably attached to the leading edge of said film strip such that said film strip is pulled along said path at a substantially constant speed when said motor is caused to operate.

16. The apparatus of claim 8 wherein said liquid material comprises an ultraviolet curable material, and wherein said curing device comprises an ultraviolet curing chamber having at least one ultraviolet lamp, said at least one ultraviolet lamp being positioned to direct ultraviolet light at said film strip in the area where said liquid material has been applied, thereby effecting the curing of said liquid material.

17. The apparatus of claim 8 further including means for cleaning said at least one surface of said film strip prior to the application of said protective coating thereto.

18. The apparatus of claim 8 wherein said film strip is a photographic film strip bearing an image on one surface thereof, and said liquid material comprises an ultraviolet curable material capable of curing into a substantially transparent protective coating.

19. The apparatus of claim 8 wherein said protective coating has a thickness ranging from about 2.5 microns to about 7.5 microns.

* * * * *